US006901914B1

(12) United States Patent
Becene et al.

(10) Patent No.: US 6,901,914 B1
(45) Date of Patent: Jun. 7, 2005

(54) VARIABLE STIFFNESS FUEL RAIL PULSE DAMPER HAVING EXTENDED DYNAMIC RANGE

(75) Inventors: Ahmet T. Becene, Henrietta, NY (US); Charles W. Braun, Livonia, NY (US); Gary J. DeAngelis, Spencerport, NY (US); Christopher L. Lewis, Rochester, NY (US); Rao M. Arvind, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/928,358

(22) Filed: Aug. 27, 2004

(51) Int. Cl.[7] ..... F02M 55/04
(52) U.S. Cl. ..... 123/456; 123/467; 138/26
(58) Field of Search ..... 123/456, 467, 123/468, 469; 138/26, 30

(56) References Cited

U.S. PATENT DOCUMENTS 5,516,266 A * 5/1996 Talaski ..... 417/540
5,575,262 A * 11/1996 Rohde ..... 123/467
5,617,827 A * 4/1997 Eshleman et al. ..... 123/456
6,148,798 A * 11/2000 Braun et al. ..... 123/467
6,314,942 B1 * 11/2001 Kilgore et al. ..... 123/467
6,431,149 B1 * 8/2002 Schwegler et al. ..... 123/467
6,443,131 B1 * 9/2002 Bueser ..... 123/467
6,513,500 B2 * 2/2003 Braun et al. ..... 123/456
6,568,370 B1 * 5/2003 Treusch et al. ..... 123/467
6,640,783 B2 * 11/2003 Braun et al. ..... 123/467
6,672,286 B2 * 1/2004 Miandoab et al. ..... 123/456

* cited by examiner

*Primary Examiner*—Weilun Lo
(74) *Attorney, Agent, or Firm*—Jimmy L. Funke

(57) ABSTRACT

A fluid pulse damper having increased dynamic range and sensitivity, being especially useful in suppressing pulsations in the fuel supply rail of an internal combustion engine. The damper is a longitudinal gas-filled plastic pillow having walls formed by opposed flexible short sides and opposed flexible long sides, and includes at least one internal self-contact element, and preferably a plurality of such elements. As the short sides flex, the elements make contact internally, shifting the damper into a different compression regime and extending the pressure/response over an increased range of pressures. A feature of some embodiments is that the inner surface within the contact elements is shifted into tension after the elements make contact, thereby stiffening the damper and increasing the damper's resistance to further deformation. The damper is formed of a plastic such as ultra-high molecular weight polyethylenes, high flow polyetherimides, or tubing grade polyphthalamides.

13 Claims, 4 Drawing Sheets

VARIABLE STIFFNESS FUEL RAIL PULSE DAMPER HAVING EXTENDED DYNAMIC RANGE

TECHNICAL FIELD

The present invention relates to fuel rails for internal combustion engines; more particularly, to devices for damping pulses in fuel being supplied to an engine via a fuel rail; and most particularly, to an improved fuel rail internal damper having increased dynamic range.

BACKGROUND OF THE INVENTION

Fuel rails for supplying fuel to fuel injectors of internal combustion engines are well known. A fuel rail is essentially an elongate fuel manifold connected at an inlet end to a fuel supply system and having a plurality of ports for mating with a plurality of fuel injectors to be supplied.

Fuel rail systems may be recirculating, as is commonly employed in diesel engines. Fuel rails are more typically "returnless" or dead ended, wherein all fuel supplied to the fuel rail is dispensed by the fuel injectors.

A well-known problem in fuel rail systems, and especially in returnless systems, is pressure pulsations in the fuel itself. It is known that fuel system damping devices are useful in controlling fuel system acoustical noise and in improving cylinder-to-cylinder fuel distribution. Various approaches for damping pulsations in fuel delivery systems are known in the prior art.

For a first example, one or more metal spring diaphragm devices may be attached to the fuel rail or fuel supply line. These provide only point damping and can lose function at low temperatures. They add hardware cost to an engine, complicate the layout of the fuel rail or fuel line, can allow permeation of fuel vapor, and in many cases simply do not provide adequate damping.

For a second example, the fuel rail itself may be configured to have one or more relatively large, thin, flat metal sidewalls which can flex in response to sharp pressure fluctuations in the supply system, thus damping pressure excursions by energy absorption. This configuration can provide excellent damping over a limited range of pressure fluctuations but it is not readily enlarged to meet more stringent requirements for pulse suppression.

For a third example, a fuel rail may be configured to accept an internal damper comprising a sealed metal pillow typically having a flat oval cross-section and formed of thin stainless steel. Air or an inert gas is trapped within the pillow. The wall material is hermetically sealed and impervious to gasoline. Such devices have rigid sidewalls supporting and separating relatively large, flat or nearly-flat flexible diaphragm sides that can flex in response to rapid pressure fluctuations in the fuel system. The flexing absorbs the energy of the pressure spike and reduces the wave speed of the resultant pressure wave, thereby reducing the amplitude of the pressure spike. Internal dampers have excellent damping properties, being easily formed to have diaphragm-like walls on both flat sides, and can be used in rails formed of any material provided the rail is large enough to accommodate the damper within. An internal damper may be advantageous over the wall-formed damper, in that mechanical failure of the damper results only in flooding of the damper itself and not in an external fuel leak.

The damping characteristics of a prior art internal damper are a function of the thickness of the diaphragm wall, the total wall area, the volume of captive air, and the mechanical characteristics of the metal. To increase the damping capability of an internal damper by applying prior art technology requires an increase in the captive air volume, a thinner wall, or increased area of the walls.

Reducing wall thickness is not desirable because it reduces the functional margin between stress and yield. Increasing the diaphragm wall area is feasible provided that a) the resulting damper is flexible enough to achieve the desired minimum change in volume for a given change in pressure without approaching the material yield point; b) the resulting damper will withstand cyclic fatigue; and c) the resulting damper is still small enough to fit into the fuel rail. Increasing the size of a fuel rail to accommodate a damper having a larger diameter or longer length is highly undesirable because the space adjacent the engine in a vehicle is already highly congested and limited, and because a new fuel rail design or layout increases the cost of manufacturing an engine.

The damping response of a prior art metal damper is essentially linear and has a limited linear range of response. Thus, a damper having excellent low-amplitude damping characteristics also has a relatively short range of amplitude-damping response capability. What is needed in the art is a fuel rail internal damper that can be tuned to meet fuel system pressure requirements having a variable, non-linear, and progressive stiffness to accommodate a greater range of pressure fluctuations in a given damper volume.

It is a principal object of the present invention to provide a greater range of pulse amplitude-damping capability in a fuel rail internal pulse damper while requiring no change in the size of a fuel rail accepting the damper.

SUMMARY OF THE INVENTION

Briefly described, an improved internal pulse damper in accordance with the invention has increased dynamic range and sensitivity. The pulse damper is useful in suppressing pulsations within any fluid body, whether moving or still, and is especially useful in suppressing pulsations in the fuel supply rail of an internal combustion engine.

The improved damper is a longitudinal gas-filled pillow having a modified flat oval cross-sectional profile, with two long, flat flexible sides (the "diaphragm" sides) and two short non-flat flexible sides connecting the two long sides. The damper includes at least one internal self-contact element, and preferably a plurality of such elements, formed on the inner surface of the long sides.

As the long sides flex inwards, and the short sides also flex, at a predetermined level of pressure the one or more self-contact elements make contact internally, thereby shifting the damper into a different compression regime. Additional pressure can cause additional internal contact elements to make contact, thus shifting the damper into yet another one or more compression regimes, as only the diaphragm sides can undergo further deformation. The result is that the pressure/response performance of such a damper can be tuned by varying the shape and thickness of the walls and contact elements and is extended over a much greater range of pressures than can be obtained with a simple pillow as in the prior art.

Further, a damper in accordance with the invention is formed preferably of a plastic polymer having much higher compliance than the stainless steel used in prior art dampers. Typical classes of plastics suitable for use in an improved damper are, among others, ultra-high molecular weight polyethylenes, high flow polyetherimides, and tubing grade polyphthalamides.

A damper in accordance with the invention may assume any of several cross-sectional shapes permitting opposed sides to self-contact, thus increasing the stiffness and minimizing the resultant stresses during high pressure events.

In a preferred embodiment, the inner surfaces of the opposed long sides are each provided with two opposing longitudinal internal contact points which, when they meet, divide the internal space into a central chamber within the contact points and two peripheral chambers outboard of the contact points within the short sides. Further pressure causes further compression of the central chamber. An important element in providing the extended compression range in some embodiments is that the inner surface within the contact points is shifted into tension after the points make contact, thereby stiffening the damper and increasing the damper's resistance to further deformation.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
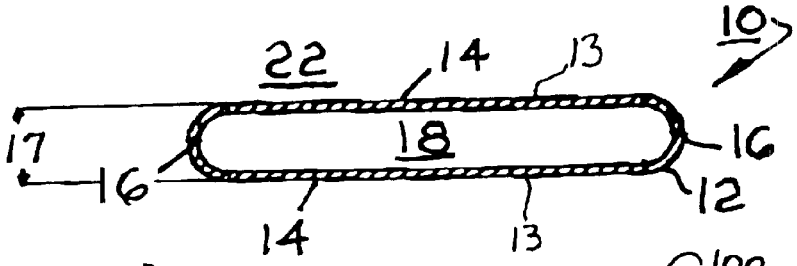
FIG. 1 (PRIOR ART)
FIG. 1 is a cross-sectional view of a prior art pulse damper.

Referring to FIG. 1, a prior art internal pulsation damper 10 for inclusion within a fuel rail for an internal combustion engine is formed as an elongate pillow 12, FIG. 1 showing a transverse cross-sectional view thereof. Pillow 12 is provided with walls 13 having first and second flexible diaphragm sides 14 separated and connected by longitudinal rigid short sides 16 of height 17 (typically about 5.0 mm) which are typically curved as shown such that the cross-sectional shape is referred to in the prior art as a "flat oval." Sides 14 are joined (not shown) at the ends of pillow 12, as by compression of sides 14 (pinching) and welding of sides 14 together, to form a sealed chamber 18 within pillow 12. Chamber 18 is filled with a gas, preferably air. Pillow 12 is disposed within a fuel rail (not shown in FIG. 1 but similarly to improved damper 700 shown disposed in a fuel rail 760 in FIG. 8). The aspect ratio of pillow 12, that is, the ratio of the typical height of sides 16 (5.0 mm) to the typical width of sides 14 (18 mm) is about 5.0/18=0.28.

In operation, pillow 12 is surrounded by fuel 22 being pumped from a source to fuel injectors (not shown) connected to the fuel rail. Hydraulic pulses being transmitted through fuel 22 are absorbed by inward/outward flexure of diaphragm sides 14 and corresponding compression/expansion of gas in chamber 18. The work done in flexing the diaphragm sides and compressing the gas consumes the energy of a pulse.

Referring to FIGS. 2 through 7, schematic cross-sectional views of several exemplary embodiments of an improved internal pulsation damper in accordance with the invention are shown. For simplicity, in FIGS. 2 through 5, the wall thickness is omitted. All of these embodiments preferably are formed, as by extrusion, of a durable organic polymer, as described in more detail below, rather than of stainless steel as in the prior art. Each embodiment is formed as a modified flat oval generally similar in size and outer dimensions at rest to prior art damper 10.

Figure 2:
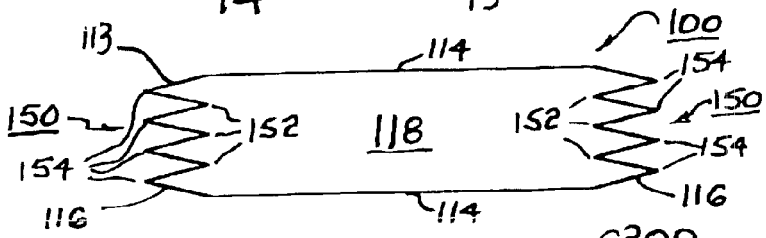
FIGS. 2 through 7 are schematic cross-sectional views of six exemplary embodiments of variable-stiffness dampers in accordance with the invention.

Referring to FIG. 2, embodiment 100 is formed having walls 113 having a plurality of accordion pleats 150 in short sides 116 separating diaphragm sides 114. Sides 114 are of uniform thickness. Damping results from progressive compression of pleats 150 in response to pressure applied to sides 114. Different ones of pleats 150 may be formed to have different thicknesses or otherwise differing flexural 20 characteristics such that resistance to compression of embodiment 100 increases progressively rather than linearly in accordance with Boyle's Law. Sides 116 are formed such that flexuring occurs at the inner 152 and outer 154 creases in pleats 150. As the pleats progressively collapse and self-contact by flexing at creases 152,154, both within and without chamber 118, resistance progressively increases. As accordion pleats 150 become progressively compressed, diaphragm sides 114 undergo continued deformation to extend the dynamic range of the damper.

Figure 3:
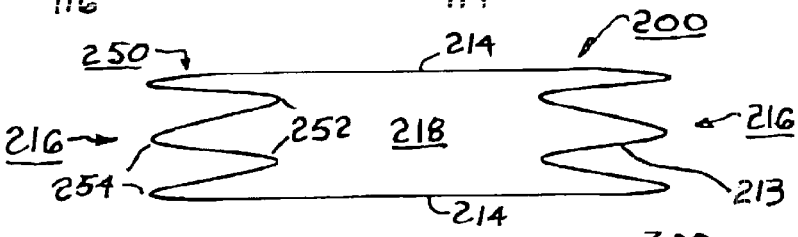

Referring to FIG. 3, embodiment 200 is similar to embodiment 100, having walls 213 including generally pleated short sides 216 and diaphragm sides 214; sides 214 are of uniform thickness. However, pleats 250 are more general folds 252,254 rather than sharp creases 152,154 and stiffness is controlled by variable curvature of the pleat portions between the folds. This design can allow the damper to completely collapse some of the side walls at various pressure levels by self-contacting, thus increasing the stiffness and minimizing the resultant stresses during high-pressure events.

Figure 4:
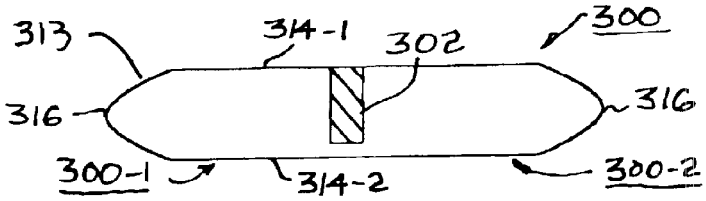

Referring to FIG. 4, self-contacting within a damper may be fostered and controlled by inclusion of one or more internal contact elements. In embodiment 300, a self-contact element 302 extends from a first diaphragm side 314-1 of wall 313 across chamber 318 toward the second diaphragm side 314-2 of wall 313. The length of element 302 is selected to provide a predetermined amount of flexure in sides 316 before element 302 makes contact with side 314-2. After such contact has occurred, embodiment 300 becomes essentially two half-size mirror-image dampers 300-1, 300-2, each having different pressure response characteristics than damper 300. Thus the damper is moved into a different pressure/response regime.

Figure 5:
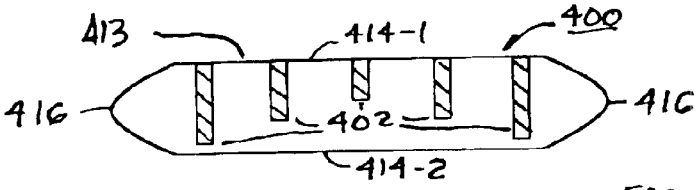

Referring to FIG. 5, embodiment 400 shows that multiple self-contact elements 402 may be employed, and by careful selection of their various lengths, a progressive and controlled collapse of embodiment 400 may be produced in response to increasing pressure, first by flexure of short sides 416 followed by flexure of diaphragm sides 414-1, 414-2 of walls 413.

Figure 6:
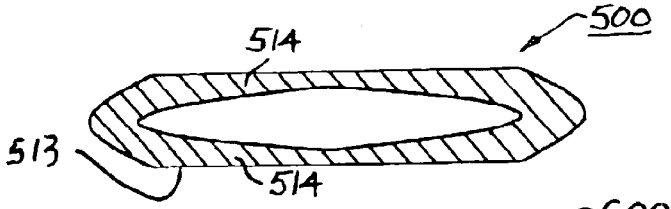

Referring to FIG. 6, in embodiment 500, walls 513 having diaphragm sides 514 have significant thickness, and taper in thickness from center to edge. Sides 514 can flex inwards under pressure. Under a predetermined external pressure, sides 514 self-contact. Due to the cross-sectional shape, the self-contact will initiate closer to the sides of the damper and work its way progressively towards the center of the damper as pressure continues to increase. This embodiment provides a continuously variable damper response characteristic.

Figure 7:
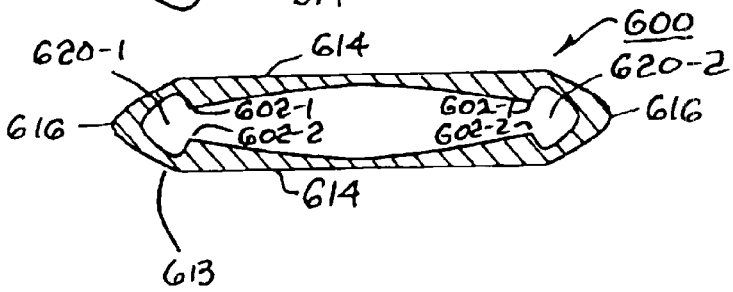

Referring to FIG. 7, embodiment 600 is similar to embodiment 500 in having walls 613 including tapered diaphragm sides 614, but short sides 616 are thinned down to provide greater flexure by providing first and second side galleries 620-1, 620-2 further defining first and second contact elements 602-1, 602-2. As pressure is applied to embodiment 600, not only do sides 614 flex inwards, but sides 616 also flex outwards until the contact elements meet, at which point the damper consists of three separate chambers: one central chamber and two lateral chambers formed from galleries 620-1, 620-2.

Figure 8:
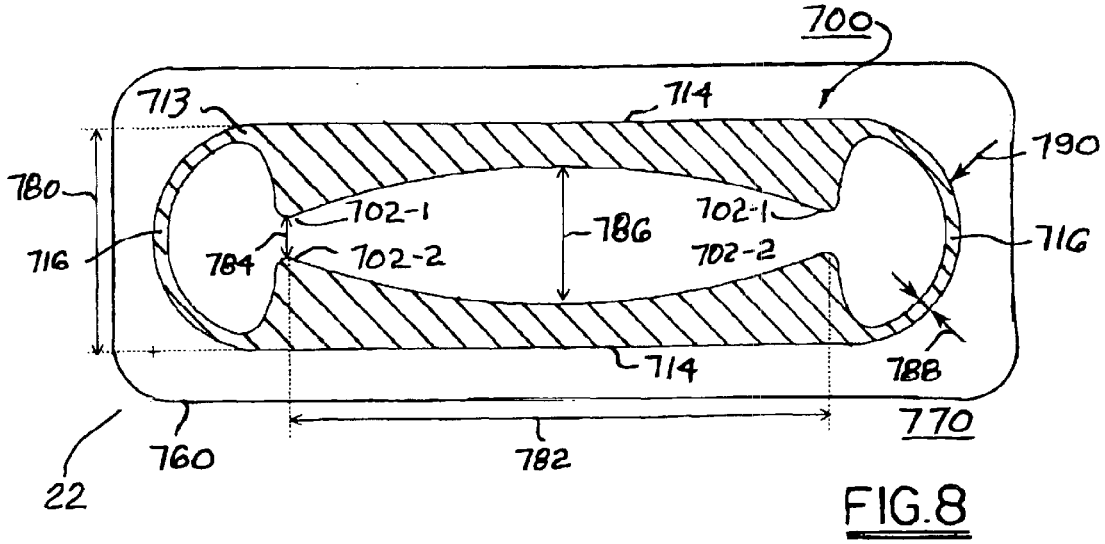
FIG. 8 is a cross-sectional view of a currently-preferred embodiment of a variable-stiffness damper, shown disposed within a fuel rail in an engine.
Figure 9:
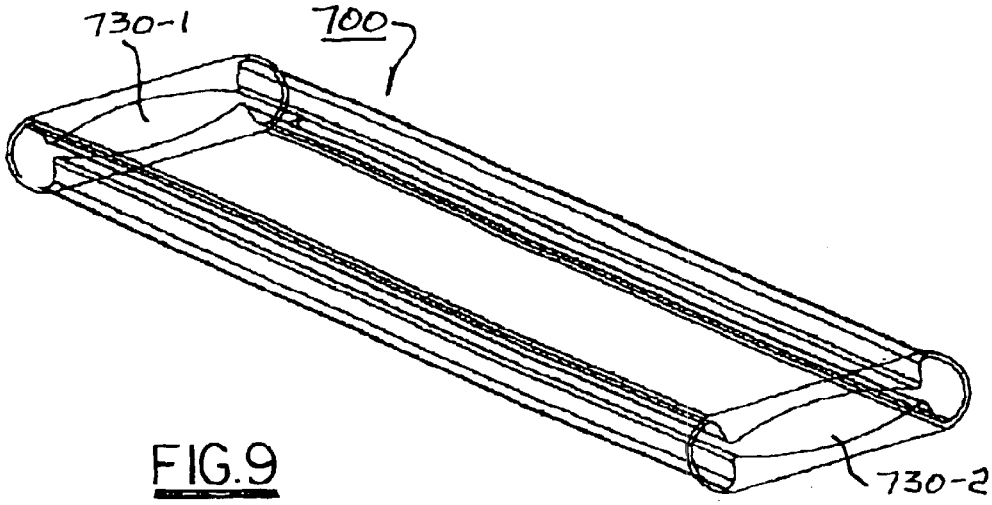
FIG. 9 is an isometric wire drawing of the damper shown in FIG. 8.

Referring to FIGS. 8 and 9, a currently-preferred embodiment 700 is a refinement of embodiment 600 in that sides 716 of walls 713 are thinned still further to provide ready flexure at low pressures. Thus, at low pressures, embodiment 700 behaves much like embodiments 100,200,300,400 wherein short-wall flexure absorbs most of the energy in low-pressure fluctuations. When pressure is sufficient to cause first and second contact elements 702-1, 702-2 to touch, a central chamber 718 (FIG. 12) is formed, and further energy absorption occurs principally by inward deformation of diaphragm sides 714. The damper is thus an essentially two-stage device wherein the thin, curved'side walls 716 respond to low-amplitude pressure waves, and the diaphragm walls 714 respond to high-amplitude pressure waves.

Embodiment 700 shown in FIG. 9 is shown as open-ended, but of course that is simply a representative longitudinal portion of an actual damper, which would have ends 730-1,730-21 closed as by separate end pieces (not shown) or by being crimped and fused shut to capture gas within the damper in known fashion.

Figure 12:
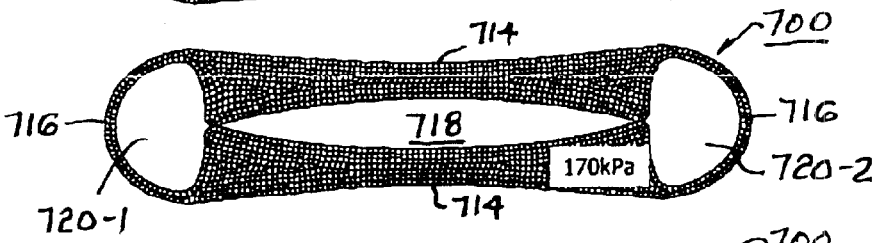
Figure 13:
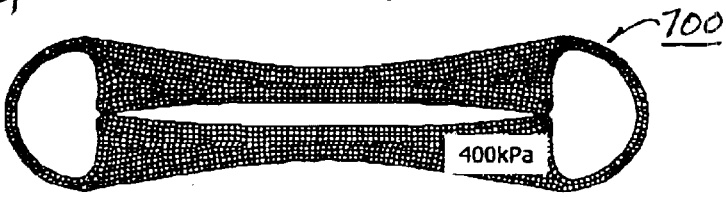
Figure 14:
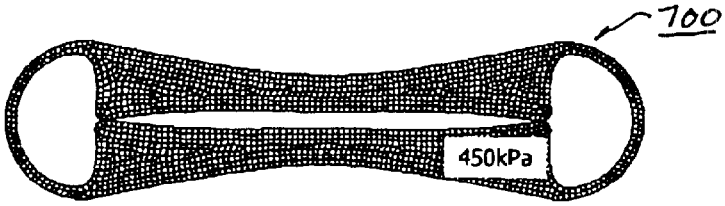
Figure 15:
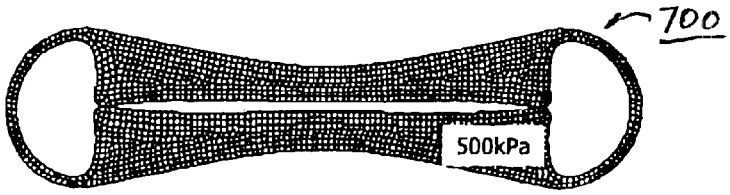
Figure 16:
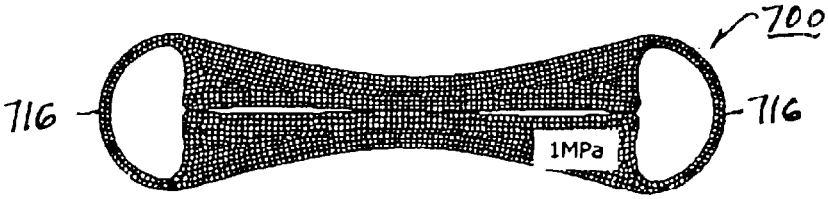

Referring to FIGS. 10 through 16, a finite element analysis of embodiment 700 shows deformations of sides 714 and 716 at various external pressures between 0 MPa (FIG. 10) and 1 MPa (FIG. 16). It is seen that contact elements 702-1, 702-2 touch at about 170 kPa (FIG. 12). At pressures below that level, diaphragm sides 714 are urged toward one another almost without deformation by decreasing the radius of curvature of sides 716. Once the contact elements meet, forming lateral chambers 720-1 and 720-2, sides 716 participate very little in further pressure absorption. Embodiment 700 is shifted to a second pressure/response regime wherein deformations of sides 714 are accompanied by changes in volume in central chamber 718 (FIGS. 12–16).

Figure 10:
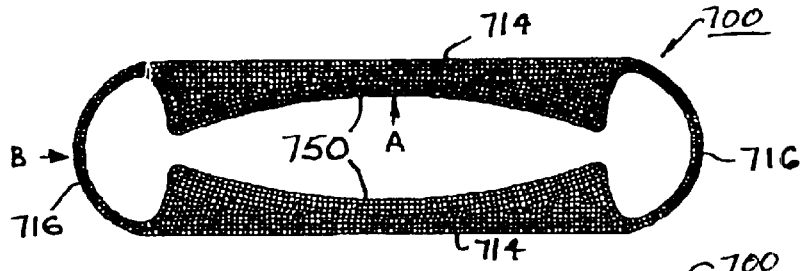
FIGS. 10 through 16 are cross-sectional views of the damper shown in FIGS. 8 and 9, taken over a range of external pressures to show the: progressive compression and distortion of the damper.
Figure 11:
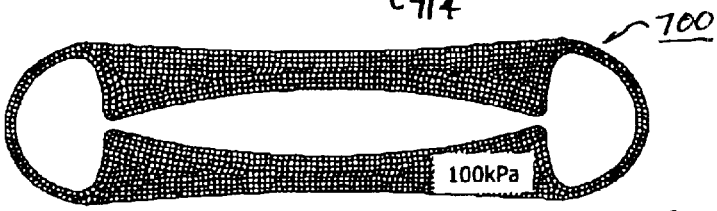
Figure 17:
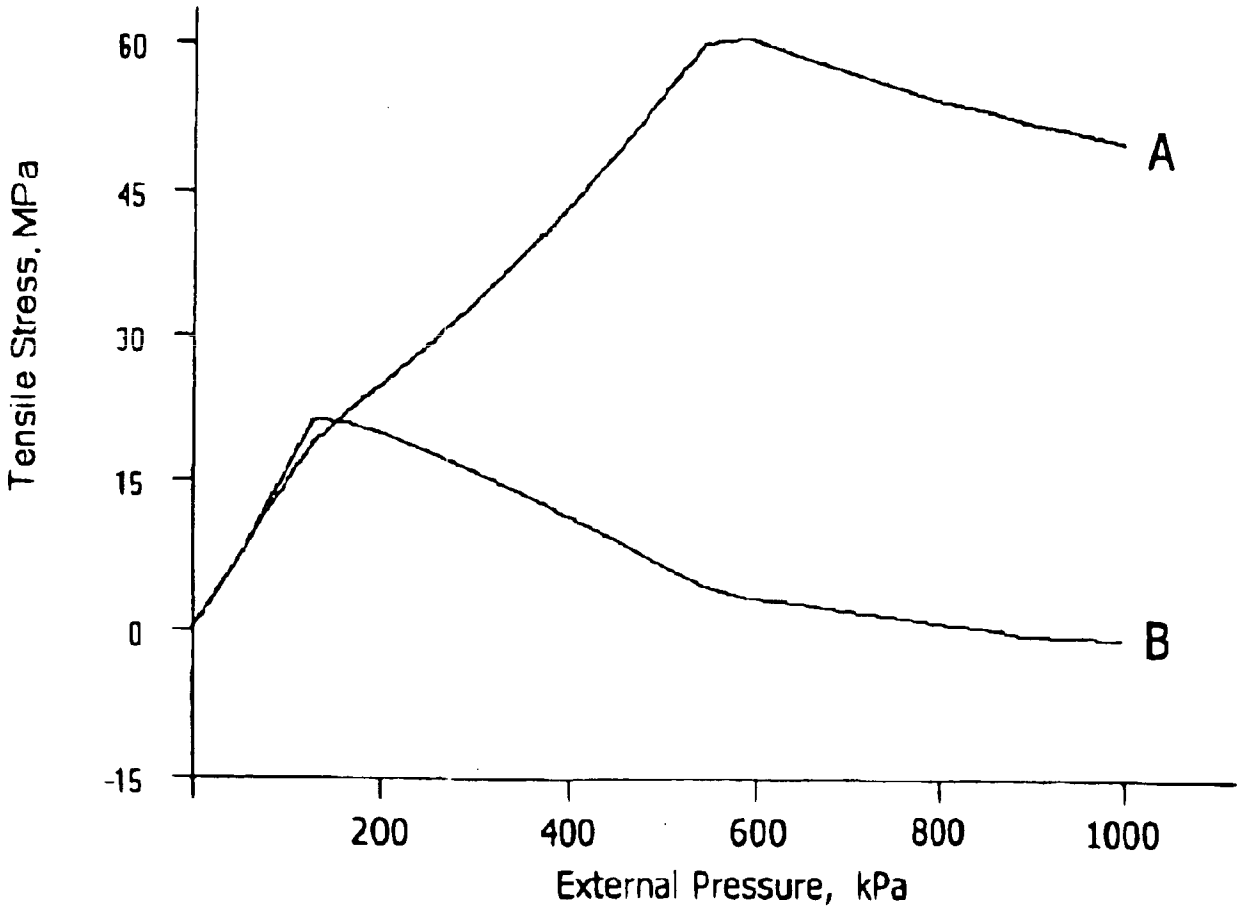
FIG. 17 is a graph showing tensile stress in the damper at points A and B, as shown in FIG. 10, as a function of the pressure range shown in FIGS. 10 through 16.

Embodiment 700 introduces a new factor, variable tension in the structure itself, into the overall pressure absorption of a damper. Referring to FIGS. 10 and 17, it is seen that tensile stress in sides 716 (as measured at point B and shown as curve B) increases, as might be expected, at imposed pressures up to about 170 kPa, as the radius of sides 716 is progressively reduced. However, once the internal self-contact occurs, the stress at point B abruptly decreases. On the other hand, the tensile stress at point A (shown as curve A) increases essentially linearly up to about 600 kPa, and then decreases at still higher pressures. Finite element analysis shows that the reason for the continuation in stress at point A is the flattening of the arch 750 formed in each side 714 whereby the polymer molecules along the inner surface of the arch are drawn into extension.

Referring again to FIG. 8, in a currently-preferred configuration of embodiment 700, as may be suitable for insertion into a fuel rail 760 of an internal combustion engine 770 for damping operating pulses in fuel 22 being supplied via fuel rail 760 to the combustion chambers (not shown) of engine 770, overall height 780 may be about 5 mm; width 782 between the contact points, about 11 mm; height 784 of the gap between opposed contact points, about 0.8 mm; maximum height 786 between arches 750, about 3 mm; thickness 788 of sides 716, about 0.3 mm; and radius 790 of sides 716, about 2.5 mm.

Materials suitable for forming a pulsation damper in accordance with the invention may be selected from a wide range of classes of organic polymers, including, but not limited to, polyimide, polyamide-imide, polyetherimide, polyphenylene sulfide, polysulfone, polyethersulfone, polytetrafluoroethylene, Ethylene Tetrafluoroethylene (ETFE), Per Fluoro Alcoxy (PFA), Fluorinated Ethylene Propylene (FEP), polyetheretherketone, partially or completely aromatic polyamides (PA6T/6I, PA6T/XT, PA6T/6I/66, etc.), aliphatic polyamides (PA6, PA66, PA612, PA46, PA11, PA12, etc.), acetal, ultrahigh molecular weight polyethylene, polypropylene, copolymers of polypropylen, polyethylene, metalocene polymers, polyurethane (i.e., isoplast), syndiotactic polystyrene, and aliphatic polyketone. Preferably, the yield strain of the polymer is around 10% or higher. For use in fuel rails, the polymer must have a high resistance to hydrocarbon and ethanol fuels and a temperature stability from about −40° C. to about 120° C.

A currently preferred polymer is a polyetherimide, available as GE Ultem 1010 from General Electric Corp., Schenectady, N.Y., USA.

While the embodiments shown were described as dampers used in fuel rails, it is understood, that a damper in accordance with the invention is not limited to fuel rails. A damper in accordance with the invention can be used in any fluid-containing vessel (liquid or gas) for the purpose of absorbing pressure excursions by energy absorption.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A pulse damper for inclusion within a fluid medium for suppressing pulsations therein, comprising walls having first and second flexible sides connecting and separating third and fourth diaphragm sides, said first, second, third, and fourth sides being sealed at first and second ends thereof to form an elongate pillow having a captive-gas chamber therewithin, at least one of said first, second, third and forth sides being constructed of at least one of a varied cross-section shape and a varied cross-section thickness to produce a non-linear response to said pulsations, wherein said third and fourth sides are tapered in wall thickness.

2. A pulse damper in accordance with claim 1 said walls are formed from materials including an organic polymer.

3. A pulse damper in accordance with claim 2 wherein said organic polymer is selected from the group consisting of polyimide, polyamide-imide, polyetherimide, polyphenylene sulfide, polysulfone, polyethersulfone, polytetrafluoroethylene, Ethylene Tetrafluoroethylene (ETFE), Per Fluoro Alcoxy (PFA), Fluorinated Ethylene Propylene (FEP), polyetheretherketone, partially or completely aromatic polyamides aliphatic polyamides acetal, ultrahigh molecular weight polyethylene, polypropylene, copolymers of polypropylene/polyethylene, metalocene polymers, pulyurethane, syndiotactic polystyrene, and aliphatic polyketone.

4. A pulse damper in accordance with claim 1 wherein said first and second sides are non-planar.

5. A pulse damper in accordance with claim 1 wherein said first and second sides are convex.

6. A pulse damper in accordance with claim 1 wherein a portion of said third and fourth sides may be urged into tension during said response of said damper.

7. A pulse damper in accordance with claim 1 further comprising at least one self-contact element extending inwardly from one of said third and fourth diaphragm sides.

8. A pulse damper in accordance with claim 7 comprising a plurality of said self-contact elements.

9. A pulse damper in accordance with claim 1 wherein said fluid medium is a hydrocarbon fuel.

10. A pulse damper in accordance with claim 9 wherein said pulse damper and said fuel are disposed in a fuel rail of an internal combustion engine.

11. A pulse damper for inclusion within a fluid medium for suppressing pulsations therein, comprising first and second flexible sides connecting and separating third and fourth diaphragm sides, and having a captive-air chamber therewithin, to define a two-stage device wherein said first and second sides are damping of low-amplitude pressure variations in said fluid medium and said third and fourth sides are damping of higher-amplitude pressure variations in said fluid medium, wherein said third and fourth sides are tapered in wall thickness.

12. A fuel rail for an internal combustion engine, said fuel rail comprising an internal pulse damper, including walls having first and second flexible sides connecting and separating third and fourth diaphragm sides, said first, second, third, and fourth sides being sealed at first and second ends thereof to form an elongate pillow having a captive-gas chamber therewithin, at least one of said first, second, third and forth sides being constructed of at least one of a varied cross-section shape and a varied cross-section thickness to produce a non-linear response to said pulsations, wherein said third and fourth sides are tapered in wall thickness.

13. An internal combustion engine comprising a fuel rail having an internal pulse damper, said damper including walls having first and second flexible sides connecting and separating third and fourth diaphragm sides, said, first, second, third, and fourth sides being sealed at first and second ends thereof to form an elongate pillow having a captive-gas chamber therewithin, at least one of said first, second, third and forth sides being constructed of at least one of a varied cross-section shape and a varied cross-section thickness to produce a non-linear response to said pulsations, wherein, said third and fourth sides are tapered in wall thickness.

* * * * *